US009820062B2

(12) United States Patent
Stewart

(10) Patent No.: US 9,820,062 B2
(45) Date of Patent: Nov. 14, 2017

(54) WAX RELIEF PATHWAY FOR HEARING AID SOUND INLET

(71) Applicant: Starkey Laboratories, Inc., Eden Prairie, MN (US)

(72) Inventor: Jay Stewart, Eden Prairie, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 14/959,615

(22) Filed: Dec. 4, 2015

(65) Prior Publication Data

US 2016/0165368 A1 Jun. 9, 2016

Related U.S. Application Data

(60) Provisional application No. 62/088,210, filed on Dec. 5, 2014.

(51) Int. Cl.
*H04R 25/00* (2006.01)

(52) U.S. Cl.
CPC ..... *H04R 25/654* (2013.01); *H04R 25/604* (2013.01)

(58) Field of Classification Search
USPC ..... 381/325
See application file for complete search history.

(56) References Cited

U.S. PATENT DOCUMENTS 4,800,982 A * 1/1989 Carlson ..... H04R 25/654 181/130
5,033,090 A * 7/1991 Weinrich ..... H04R 25/453 381/318
5,875,254 A * 2/1999 Hanright ..... H04R 25/456 381/324

* cited by examiner

*Primary Examiner* — Amir Etesam
(74) *Attorney, Agent, or Firm* — Schwegman Lundberg & Woessner, P.A.

(57) ABSTRACT

Certain types of hearing aids are designed to be worn completely in the ear. Examples of such hearing aids include in-the-ear (ITE), in-the-canal (ITC), completely-in-the-canal (CIC) type, or invisible-in-the-canal (IIC) hearing aids. Described herein are structures to help prevent wax accumulation in the sound port that conveys sound to the microphone. In one embodiment, an injection molded T-fitting connects to a microphone and provides both a microphone inlet pathway and a wax relief pathway.

20 Claims, 8 Drawing Sheets

WAX RELIEF PATHWAY FOR HEARING AID SOUND INLET

CLAIM OF PRIORITY

This patent application claims the benefit of U.S. Provisional Patent Application No. 61/088,210, filed Dec. 5, 2014, entitled "WAX RELIEF PATHWAY FOR HEARING AID SOUND INLET", which is incorporated by reference herein in full.

FIELD OF THE INVENTION

This invention pertains to electronic hearing aids and methods for their construction.

BACKGROUND

Hearing aids are electronic instruments that compensate for hearing losses by amplifying sound. The electronic components of a hearing aid include a microphone for receiving ambient sound, an amplifier for amplifying the microphone signal in a manner that depends upon the frequency and amplitude of the microphone signal, a speaker for converting the amplified microphone signal to sound for the wearer, and a battery for powering the components. In certain types of hearing aids, the electronic components are enclosed by housing that is designed to be worn in the ear for both aesthetic and functional reasons. Such devices may be referred to as in-the-ear (ITE), in-the-canal (ITC), completely-in-the-canal (CIC) type, or invisible-in-the-canal (IIC) hearing aids. These types of hearing aids are susceptible, however, to wax accumulation in the sound port that conveys sound to the microphone.

DETAILED DESCRIPTION

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

It is understood that variations in configurations and combinations of components may be employed without departing from the scope of the present subject matter. Hearing assistance devices typically include an enclosure or housing, a microphone, hearing assistance device electronics including processing electronics, and a speaker or receiver. The examples set forth herein are intended to be demonstrative and not a limiting or exhaustive depiction of variations.

Figure 1:
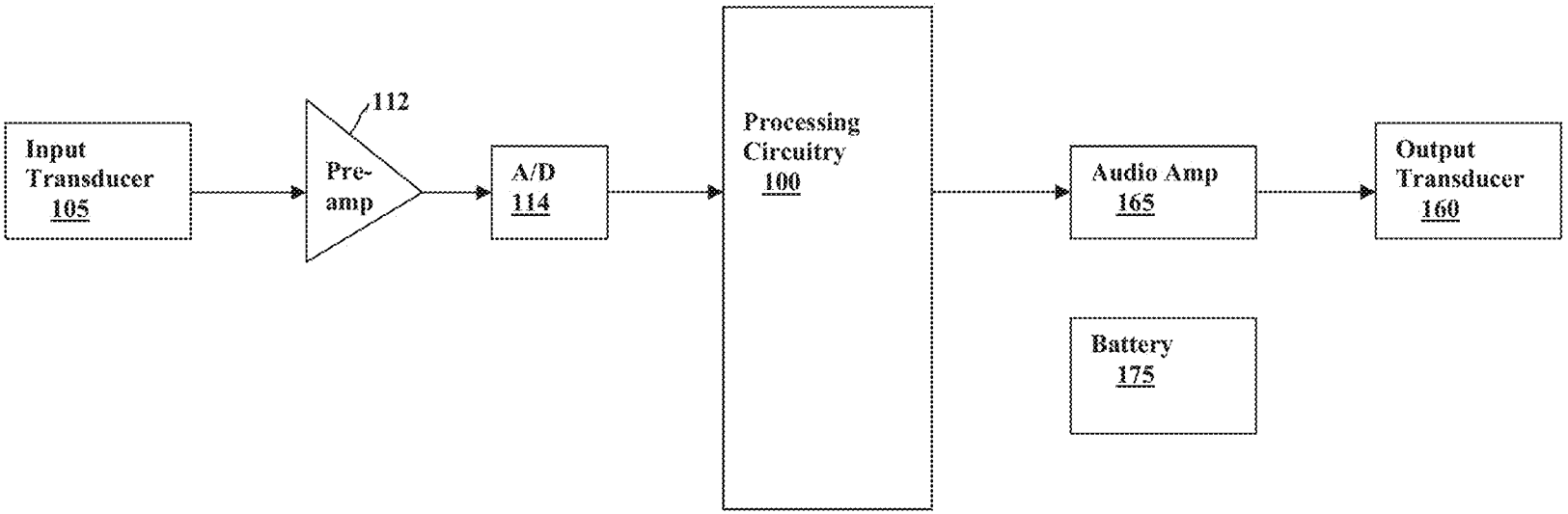
FIG. 1 shows the basic electronic components of an example hearing aid according to one embodiment.

FIG. 1 illustrates the basic functional components of an example hearing aid. The electronic circuitry of a typical hearing aid is contained within a housing that is commonly either placed in the external ear canal or behind the ear. A microphone or input transducer 105 receives sound waves from the environment and converts the sound into an input signal. After amplification by pre-amplifier 112, the input signal is sampled and digitized by A/D converter 114 to result in a digitized input signal. The device's processing circuitry 100 processes the digitized input signal into an analog output signal in a manner that compensates for the patient's hearing deficit. The output signal is then passed to an audio amplifier 165 that drives an output transducer 160 or receiver for converting the output signal into an audio output. A battery 175 supplies power for the electronic components.

Figure 2:
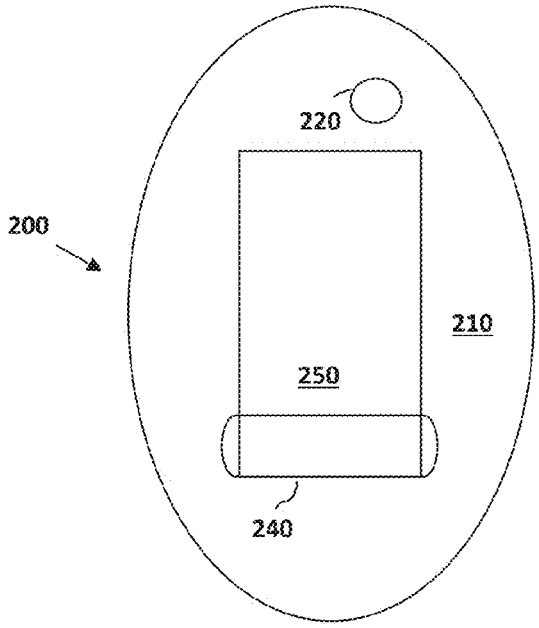
FIGS. 2-4 show the construction of a hearing aid housing with a wax relief pathway according to one embodiment.
Figure 3:
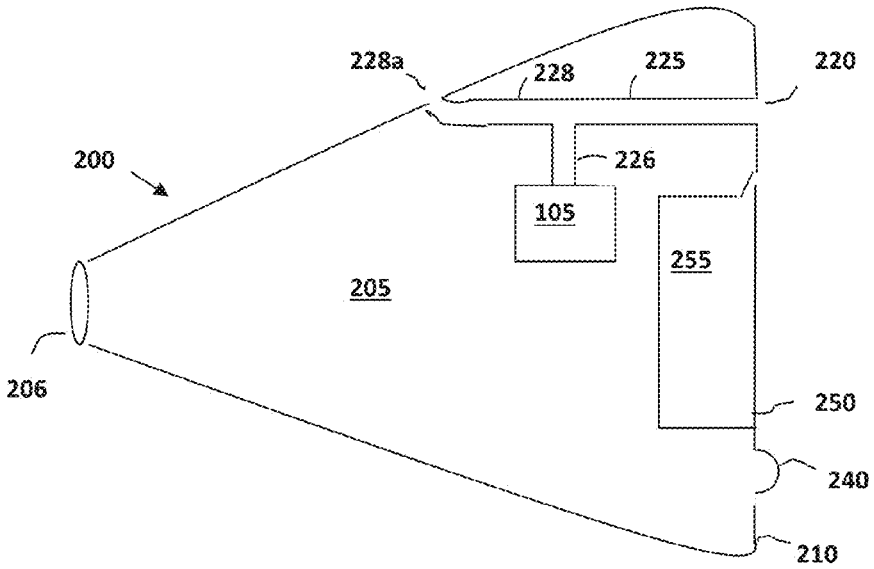

FIGS. 2 and 3 show a top view and a cross-sectional side view, respectively, of an example housing or enclosure 200 for a hearing aid. The cross-section of FIG. 3 is taken vertically through approximately the middle of FIG. 2. The enclosure is made up of an ear mold or shell 205, within which are housed the electronic components described above with reference to FIG. 1, and a faceplate 210. At the end of the ear mold opposite the faceplate is an outlet port 206 for the receiver to convey sound to the wearer's ear. The faceplate includes a sound inlet port 220. Also hingedly mounted on the faceplate via hinge 240 is a battery door 250 that opens into a battery compartment 255 to allow replacement of the battery 175.

Figure 4:
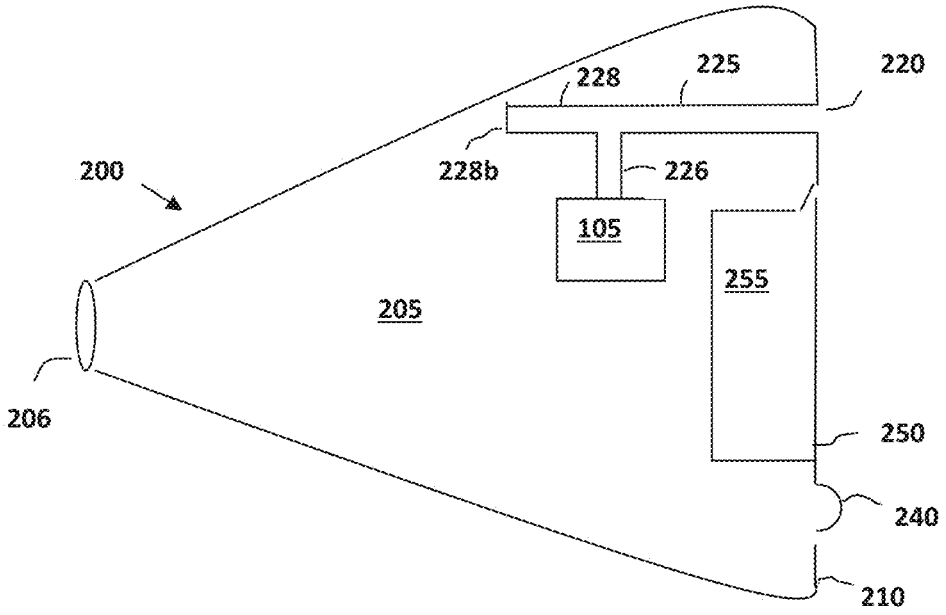

As shown in FIG. 3, the sound inlet port 220 opens into a conduit 225 that comprises a microphone inlet pathway 226 and a wax relief pathway 228. The separate microphone inlet pathway 226 and a wax relief pathway 228 may be implemented in the conduit 225, for example, by a T-fitting or a T-section of the conduit 225. As wax enters the sound inlet port 220, it can accumulate in the wax relief pathway 228 and not block the microphone inlet pathway 226. In the embodiment shown in FIG. 3, the wax relief pathway 228 is continuous with an opening 228*a* on the side of the shell 205 that is sealed by the tragal area of the ear canal when the hearing aid is inserted into the ear canal in order to avoid acoustic performance and feedback issues associated with an additional vent. In an alternative embodiment as shown in FIG. 4, the wax relief pathway terminates as a blind end 228*b*.

Figure 5:
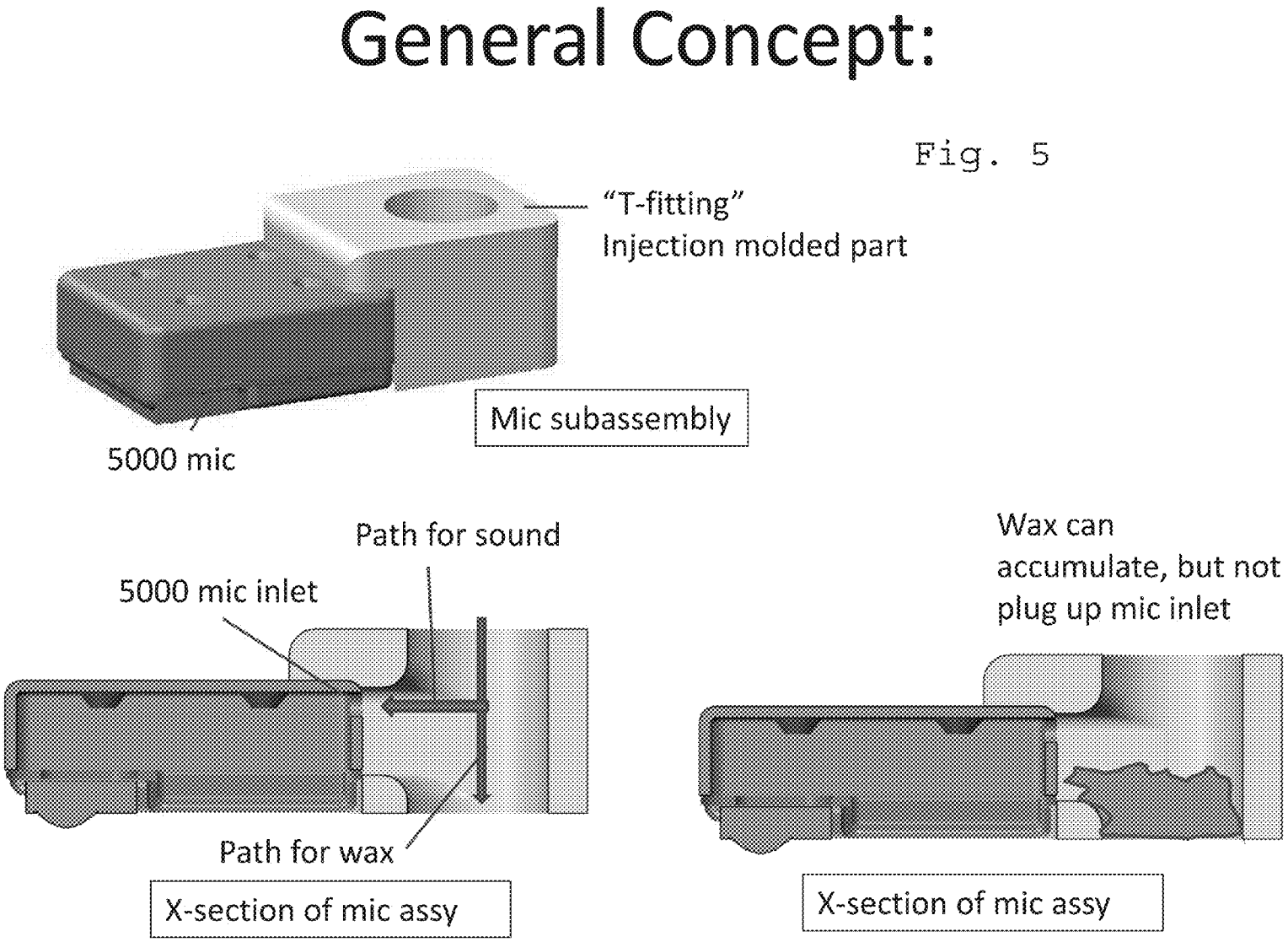
FIGS. 5-9 illustrate an example implementation of a housing with a wax relief pathway in an ITC hearing aid according to one embodiment.
Figure 6:
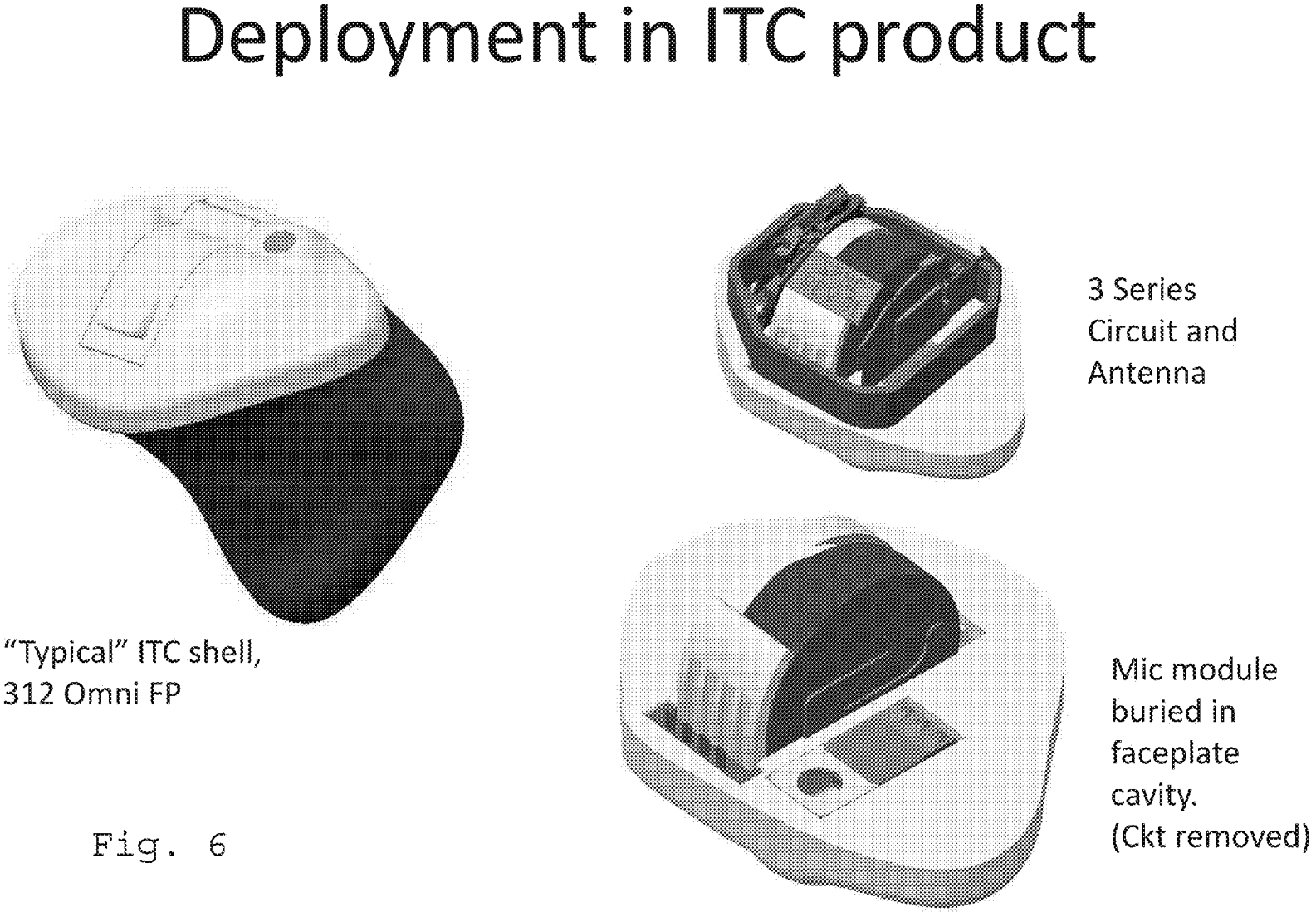
Figure 7:
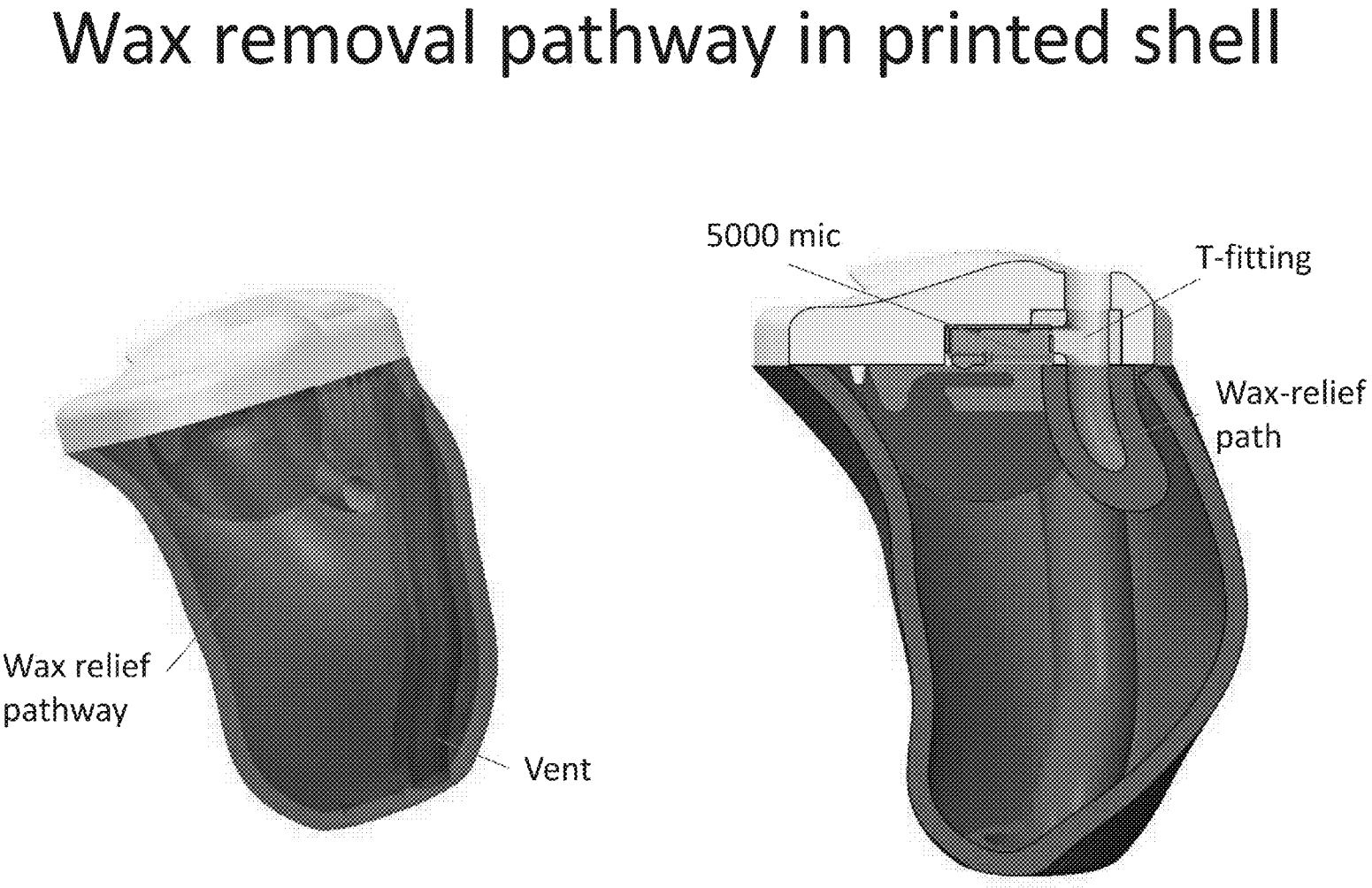
Figure 8:
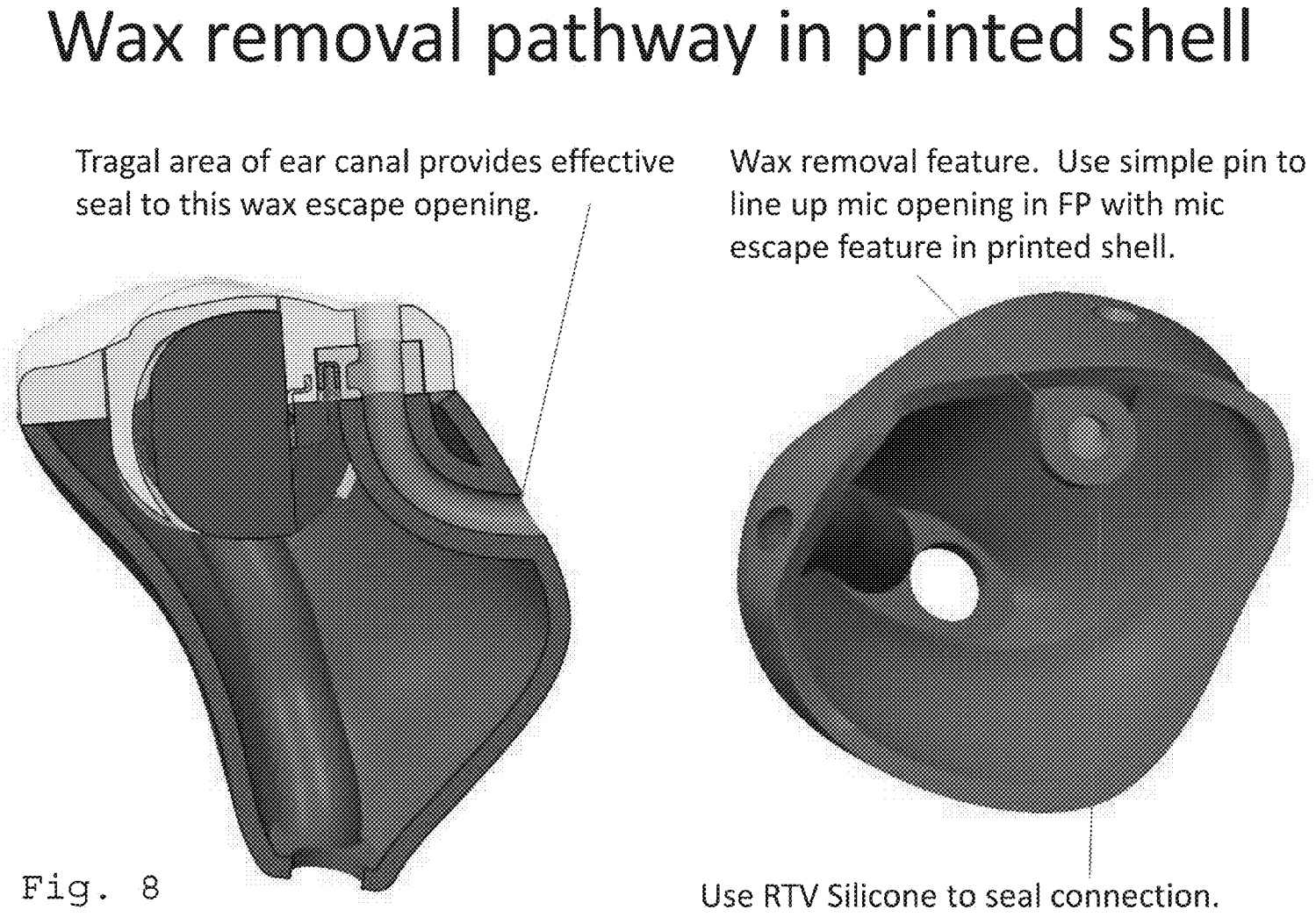
Figure 9:
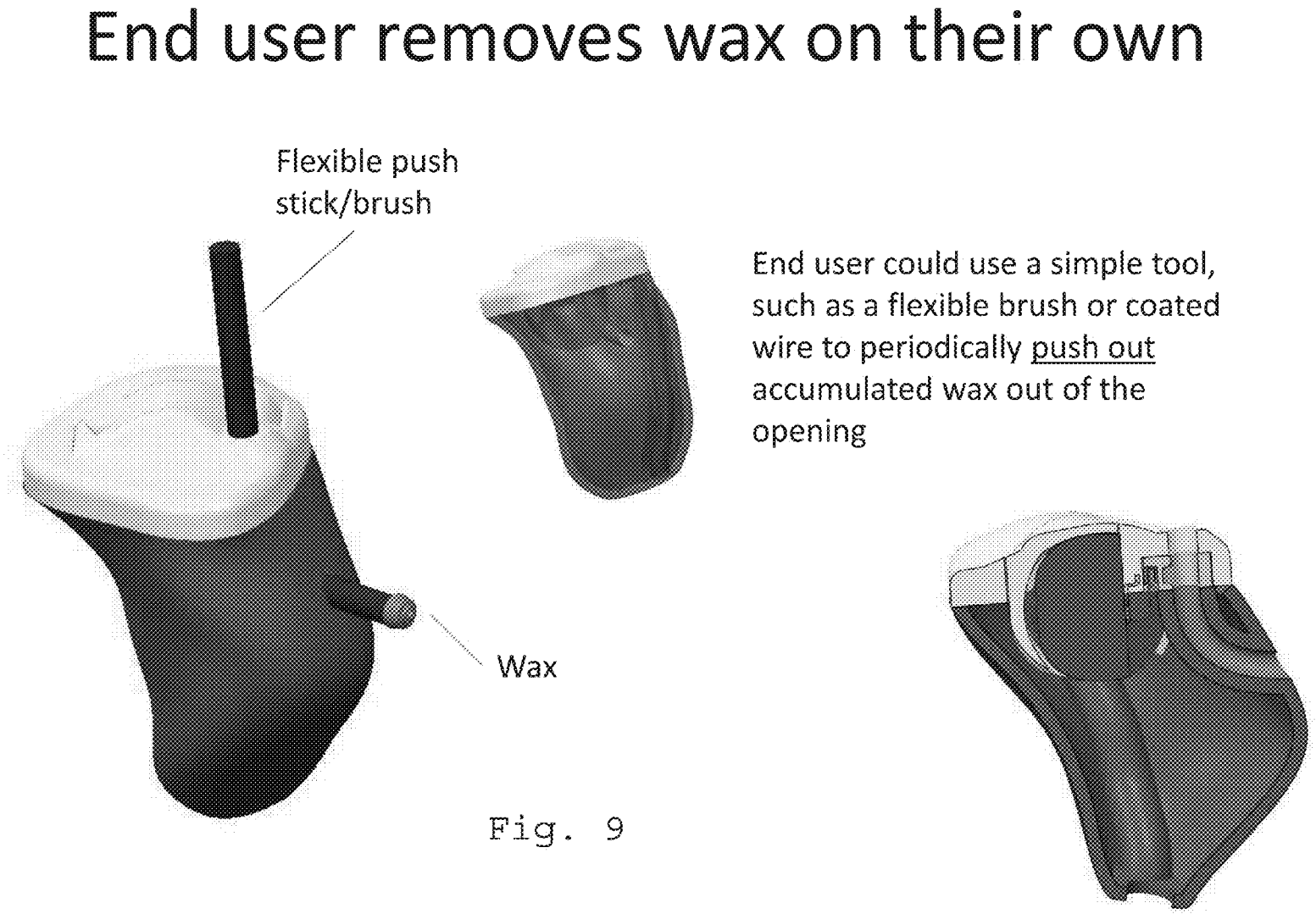

FIG. 5 shows an example according to one embodiment in which an injection molded T-fitting that connects to a microphone and provides a microphone inlet pathway and a wax relief pathway. As shown in the figure, wax may accumulate in the wax relief pathway and not obstruct the microphone inlet pathway. FIG. 6 shows an example according to one embodiment in which the concept is deployed in an ITC hearing aid. FIG. 7 shows how the wax relief pathway may be implemented in this embodiment as continuous with the T-fitting and terminating in an opening on the side of the earmold. FIG. 8 shows another view of the earmold and wax relief pathway and shows how a pin may be used to insert through the sound inlet port on the faceplate (FP) into the wax relief pathway. FIG. 9 shows how a flexible stick or brush may be used to push accumulated wax out of the wax relief pathway through the opening on the side of the earmold.

Example Embodiments

In one embodiment, a housing or enclosure for a hearing aid, comprises: an earmold for containing electronic components of the hearing aid; a faceplate attached to the earmold; and, a sound inlet port on the faceplate that is continuous with a conduit that comprises a microphone inlet pathway that conveys sound to a microphone and a wax relief pathway for accumulating wax. The microphone inlet pathway and wax relief pathway may be implemented in the conduit for by a T-fitting or a T-section of the conduit. The wax relief pathway may continuous with an opening on a side of the earmold or the wax relief pathway may terminate as a blind end.

In one embodiment, a method for constructing a housing or enclosure for a hearing aid, comprises: attaching a faceplate to an earmold for containing electronic components of the hearing aid; and providing sound inlet port on the faceplate that is continuous with a conduit that comprises a microphone inlet pathway that conveys sound to a microphone and a wax relief pathway for accumulating wax. The microphone inlet pathway and wax relief pathway may be implemented in the conduit for by a T-fitting or a T-section of the conduit. The wax relief pathway may continuous with an opening on a side of the earmold or the wax relief pathway may terminate as a blind end.

The present subject matter can be used in digital hearing aids. Digital hearing aids include a processor. In digital hearing aids with a processor programmed to provide corrections to hearing impairments, programmable gains are employed to tailor the hearing aid output to a wearer's particular hearing impairment. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory, which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

It is understood that variations in configurations and combinations of components may be employed without departing from the scope of the present subject matter. Hearing assistance devices may typically include an enclosure or housing, a microphone, processing electronics, and a speaker or receiver. The examples set forth herein are intended to be demonstrative and not a limiting or exhaustive depiction of variations.

The present subject matter can be used for a variety of hearing assistance devices, including but not limited to hearing aids such as in-the-ear (ITE), in-the-canal (ITC), or completely-in-the-canal (CIC) type hearing aids. It is understood that other hearing assistance devices not expressly stated herein may fall within the scope of the present subject matter.

This application is intended to cover adaptations or variations of the present subject matter. It is to be understood that the above description is intended to be illustrative, and not restrictive. The subject matter has been described in conjunction with the foregoing specific embodiments. It should be appreciated that those embodiments may also be combined in any manner considered to be advantageous. Also, many alternatives, variations, and modifications will be apparent to those of ordinary skill in the art. Other such alternatives, variations, and modifications are intended to fall within the scope of the following appended claims.

What is claimed is:

1. A housing for a hearing aid, comprising:

an earmold for containing electronic components of the hearing aid;

a faceplate attached to the earmold;

a sound inlet port on the faceplate that is continuous with a conduit that comprises a microphone inlet pathway that conveys sound to a microphone and a wax relief pathway directed away from the microphone inlet pathway for accumulating wax;

wherein the wax relief pathway ends without communicating with a wearer's ear canal when the hearing aid is worn.

2. The housing of claim 1 wherein the microphone inlet pathway and wax relief pathway are implemented in the conduit by a T-section of the conduit.

3. The housing of claim 1 wherein the microphone inlet pathway and wax relief pathway are implemented in the conduit by a T-fitting.

4. The housing of claim 3 wherein the T-fitting is injection molded.

5. The housing of claim 1 wherein the wax relief pathway is continuous with an opening on a side of the earmold that is sealed by the wearer's tragal area when the hearing aid is worn.

6. The housing of claim 1 wherein the wax relief pathway terminates as a blind end.

7. The housing of claim 1 wherein the hearing aid is an in-the-canal (ITC), in-the-canal (ITC), completely-in-the-canal (CIC), or invisible-in-the-canal (IIC) hearing aid.

8. A method for constructing a hearing aid housing, comprising:

attaching a faceplate to an earmold for containing electronic components of the hearing aid;

constructing a sound inlet port on the faceplate and a conduit continuous therewith that comprises a microphone inlet pathway that conveys sound to a microphone and a wax relief pathway for accumulating wax; and, wherein the wax relief pathway ends without communicating with a wearer's ear canal when the hearing aid is worn.

9. The method of claim 8 further comprising implementing the microphone inlet pathway and wax relief pathway as a I-section of the conduit.

10. The method of claim 8 further comprising implementing the microphone inlet pathway and wax relief pathway as a T-fitting.

11. The method of claim 10 further comprising injection molding the T-fitting.

12. The method of claim 8 wherein the wax relief pathway is continuous with an opening on a side of the earmold that is sealed by the wearer's tragal area when the hearing aid is worn.

13. The method of claim 8 wherein the wax relief pathway terminates as a blind end.

14. The method of claim 12 wherein the hearing aid is an in-the-canal (ITC), in-the-canal (ITC), completely-in-the-canal (CIC), or invisible-in-the-canal (IIC) hearing aid.

15. A hearing aid, comprising:

electronic components that include a microphone, processing circuitry, and a receiver;

an earmold for containing the electronic components;

a faceplate attached to the earmold;

a sound inlet port on the faceplate that is continuous with a conduit that comprises a microphone inlet pathway that conveys sound to the microphone and a wax relief pathway for accumulating wax; and, wherein the wax relief pathway ends without communicating with a wearer's ear canal when the hearing aid is worn.

16. The hearing aid of claim 15 wherein the microphone inlet pathway and wax relief pathway are implemented in the conduit by a T-section of the conduit.

17. The hearing aid of claim 15 wherein the microphone inlet pathway and wax relief pathway are implemented in the conduit by a I-fitting.

18. The hearing aid of claim 17 wherein the I-fitting is injection molded.

19. The hearing aid of claim 15 wherein the wax relief pathway is continuous with an opening on a side of the earmold that is sealed by the wearer's tragal area when the hearing aid is worn.

20. The hearing aid of claim 15 wherein the wax relief pathway terminates as a blind end.

* * * * *